US008069956B2

(12) United States Patent
Okada

(10) Patent No.: US 8,069,956 B2
(45) Date of Patent: Dec. 6, 2011

(54) ELEVATOR SPEED GOVERNOR AND ELEVATOR DEVICE

(75) Inventor: Mineo Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 442 days.

(21) Appl. No.: 12/440,950

(22) PCT Filed: Oct. 18, 2006

(86) PCT No.: PCT/JP2006/320736

§ 371 (c)(1), (2), (4) Date: Mar. 12, 2009

(87) PCT Pub. No.: WO2008/047425

PCT Pub. Date: Apr. 24, 2008

(65) Prior Publication Data

US 2009/0314586 A1 Dec. 24, 2009

(51) Int. Cl.
*B66B 5/06* (2006.01)

(52) U.S. Cl. ..... 187/287; 187/393; 187/305; 187/373

(58) Field of Classification Search ..... 187/277, 187/286, 287, 293, 305, 373, 391–393
See application file for complete search history.

(56) References Cited

U.S. PATENT DOCUMENTS

| | | | | |
|---|---|---|---|---|
| 2,511,697 | A * | 6/1950 | Clift | 187/375 |
| 6,173,813 | B1 * | 1/2001 | Rebillard et al. | 187/287 |
| 6,360,847 | B1 * | 3/2002 | Okada et al. | 187/373 |
| 6,752,246 | B2 * | 6/2004 | Takai et al. | 187/373 |
| 7,353,916 | B2 * | 4/2008 | Angst | 187/393 |
| 7,614,481 | B2 * | 11/2009 | Okamoto et al. | 187/305 |
| 2009/0314586 | A1 * | 12/2009 | Okada | 187/287 |
| 2010/0133045 | A1 * | 6/2010 | Turina | 187/201 |
| 2011/0186385 | A1 * | 8/2011 | Okada | 187/288 |

FOREIGN PATENT DOCUMENTS

| | | | |
|---|---|---|---|
| JP | 05186156 | A * | 7/1993 |
| JP | 2000 327241 | | 11/2000 |
| JP | 2001 122549 | | 5/2001 |
| JP | 2003 104646 | | 4/2003 |
| JP | 2005 523859 | | 8/2005 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

An elevator governor capable of setting first overspeeds different between a rising time and a descending time by a simple configuration and at a low cost without the need for electric power supply from the outside. For this purpose, a weight that is moved in a predetermined direction by receiving a centrifugal force according to a travel speed at the rising time and the descending time of a car, an elastic body urged by movement of the weight having received the centrifugal force, and an actuating device actuates a stop switch when the weight having received the centrifugal force moves to a predetermined position against an urging force of the elastic body are provided, and also a switching device driven by the rising/descending operation of the car is provided. By the switching device, the length of the elastic body at the time when the actuating devices actuates the stop switch is switched to a length different according to the rising/descending direction of the car.

7 Claims, 5 Drawing Sheets

ELEVATOR SPEED GOVERNOR AND ELEVATOR DEVICE

TECHNICAL FIELD

The present invention relates to a governor for an elevator having rated speeds different between the rising time and the descending time, and an elevator system provided with such a governor.

BACKGROUND ART

An elevator has a governor that constantly monitors the rising/descending speed of a car and emergency stops the car when the car falls into a predetermined overspeed state. Specifically, when the rising/descending speed of the car exceeds the rated speed and reaches a first overspeed (usually, about 1.3 times the rated speed), the governor shuts off the power supply of a driving device for driving the car and the power supply of a control unit for controlling the driving device. Also, when the descending speed of the car exceeds the first overspeed and reaches a second overspeed (usually, about 1.4 times the rated speed) from any cause, the governor activates a safety gear device provided on the car to emergency stop the car mechanically.

On the other hand, in the case where the rated speed at the descending time must be equal to or lower than a predetermined value due to the restriction of shaft pit depth, in the case where the rated speed at the descending time cannot be increased to restrain a sense of discomfort caused by sudden pressure fluctuations in the car at the time of high-speed operation, or in the like cases, it is also demanded that the elevator be provided with rated speeds different between the rising time and the descending time. To meet such a demand, there has also been proposed a governor capable of providing first overspeeds different between the rising time and the descending time (for example, refer to Patent Document 1).

Patent Document 1 describes the following governors as specific examples.

(1) A governor in which a fly ball type governing mechanism and a fly weight type governing mechanism each having a different first overspeed are provided, and when the elevator car rises, the fly ball type governing mechanism in which the first overspeed is set on the low speed side is separated by a clutch mechanism.

(2) A governor in which two fly weight type governing mechanisms having different first overspeeds are provided, and when the elevator car rises, one governing mechanism in which the first overspeed is set on the low speed side is separated by a clutch mechanism.

(3) A governor in which two fly ball type governing mechanisms having different first overspeeds are provided, and when the elevator car rises, one governing mechanism in which the first overspeed is set on the low speed side is separated by a clutch mechanism.

(4) A governor in which one governing mechanism is provided with a stop switch that is actuated at the first overspeed on the high speed side and a stop switch that is actuated at the first overspeed on the low speed side, and when the elevator car rises, the stop switch set to the low speed side is inactivated by an electric circuit.

(5) A governor in which a moving mechanism for moving the position of a stop switch according to the rising/descending direction of the car is provided, and when the elevator car rises, the stop switch is placed so as to be actuated at the first overspeed on the high speed side, and when the elevator car descends, the stop switch is placed so as to be actuated at the first overspeed on the low speed side.

Patent Document 1: Japanese Patent Laid-Open No. 2000-327241

DISCLOSURE OF THE INVENTION

Problems to be Solved by the Invention

The governor described in Patent Document I has a problem in that in the specific examples of the above items (1) to (3), two governing mechanisms must be provided, so that the governor increases in size and also increases in cost significantly. Also, the clutch mechanism for separating an unnecessary governing mechanism at the rising time and the descending time is needed. Therefore, a need for electric power supply from the outside arises, and the reliability of the electric circuit therefor must be secured. On the other hand, in the specific examples of the above items (4) and (5), the ON-OFF operation and the arrangement of the stop switch must be controlled electrically. Therefore, a need for electric power supply from the outside arises, and the reliability of the electric circuit for performing the operation must be secured.

The present invention has been made to solve the above problems, and accordingly an object thereof is to provide an elevator governor that is capable of setting first overspeeds different between the rising time and the descending time by a simple configuration and at a low cost without the need for electric power supply from the outside, and an elevator system provided with such a governor.

Means for Solving the Problems

An elevator governor of the present invention is an elevator governor for an elevator having rated speeds different between the rising time and the descending time of an elevator car, which comprises a weight which is moved in a predetermined direction by receiving a centrifugal force according to the travel speed at the rising time and the descending time of the car, an elastic body which is urged by the movement of the weight having received the centrifugal force, actuating means for actuating a stop switch when the weight having received the centrifugal force moves to a predetermined position against the urging force of the elastic body, and switching means which is driven by the rising/descending operation of the car to switch the length of the elastic body at the time when the actuating means actuates the stop switch to a length different according to the rising/descending direction of the car.

Also an elevator governor of the present invention is an elevator governor for an elevator having rated speeds different between the rising time and the descending time of an elevator car, which comprises a driving shaft which rotates in the normal direction and in the reverse direction in association with the rising and descending of the car, a weight which is moved in a predetermined direction by receiving a centrifugal force according to the rotational speed of the driving shaft, an elastic body which is urged by the movement of the weight having received the centrifugal force, actuating means for actuating a stop switch when the weight having received the centrifugal force moves to a predetermined position against the urging force of the elastic body, a DC generator for generating either of positive or negative currents according to the rotation direction of the driving shaft by means of the rotation of the driving shaft, urging means for urging one end part of the elastic body against one side by means of the flow of a current to switch the length of the elastic body at the time when the actuating means actuates the stop switch to a length different according to the presence or absence of the flowing current, and rectifying means which is provided between the DC generator and the urging means to supply only either of the positive or negative currents produced by the DC generator to the urging means.

An elevator system of the present invention is an elevator system which comprises a car which rises and descends in an elevator shaft, a driving device for driving the car, a control unit for controlling the driving device so as to provide rated speeds different between the rising time and the descending time of the car, a weight which is moved in a predetermined direction by receiving a centrifugal force according to the travel speed at the rising time and the descending time of the car, an elastic body which is urged by the movement of the weight having received the centrifugal force, actuating means for actuating a stop switch when the weight having received the centrifugal force moves to a predetermined position against the urging force of the elastic body, and switching means which is driven by the rising/descending operation of the car to switch the length of the elastic body at the time when the actuating means actuates the stop switch to a length different according to the rising/descending direction of the car.

Also an elevator system of the present invention is an elevator system which comprises, a car which rises and descends in an elevator shaft, a driving device for driving the car, a control unit for controlling the driving device so as to provide rated speeds different between the rising time and the descending time of the car, a driving shaft which rotates in the normal direction and in the reverse direction in association with the rising and descending of the car, a weight which is moved in a predetermined direction by receiving a centrifugal force according to the rotational speed of the driving shaft, an elastic body which is urged by the movement of the weight having received the centrifugal force, actuating means for actuating a stop switch when the weight having received the centrifugal force moves to a predetermined position against the urging force of the elastic body, a DC generator for generating either of positive or negative currents according to the rotation direction of the driving shaft by means of the rotation of the driving shaft, urging means for urging one end part of the elastic body against one side by means of the flow of a current to switch the length of the elastic body at the time when the actuating means actuates the stop switch to a length different according to the presence or absence of the flowing current, and rectifying means which is provided between the DC generator and the urging means to supply only either of the positive or negative currents produced by the DC generator to the urging means.

Effect of the Invention

According to the present invention, first overspeeds different between the rising time and the descending time can be set by a simple configuration and at a low cost without the need for electric power supply from the outside.

DESCRIPTION OF SYMBOLS

Figure 1:
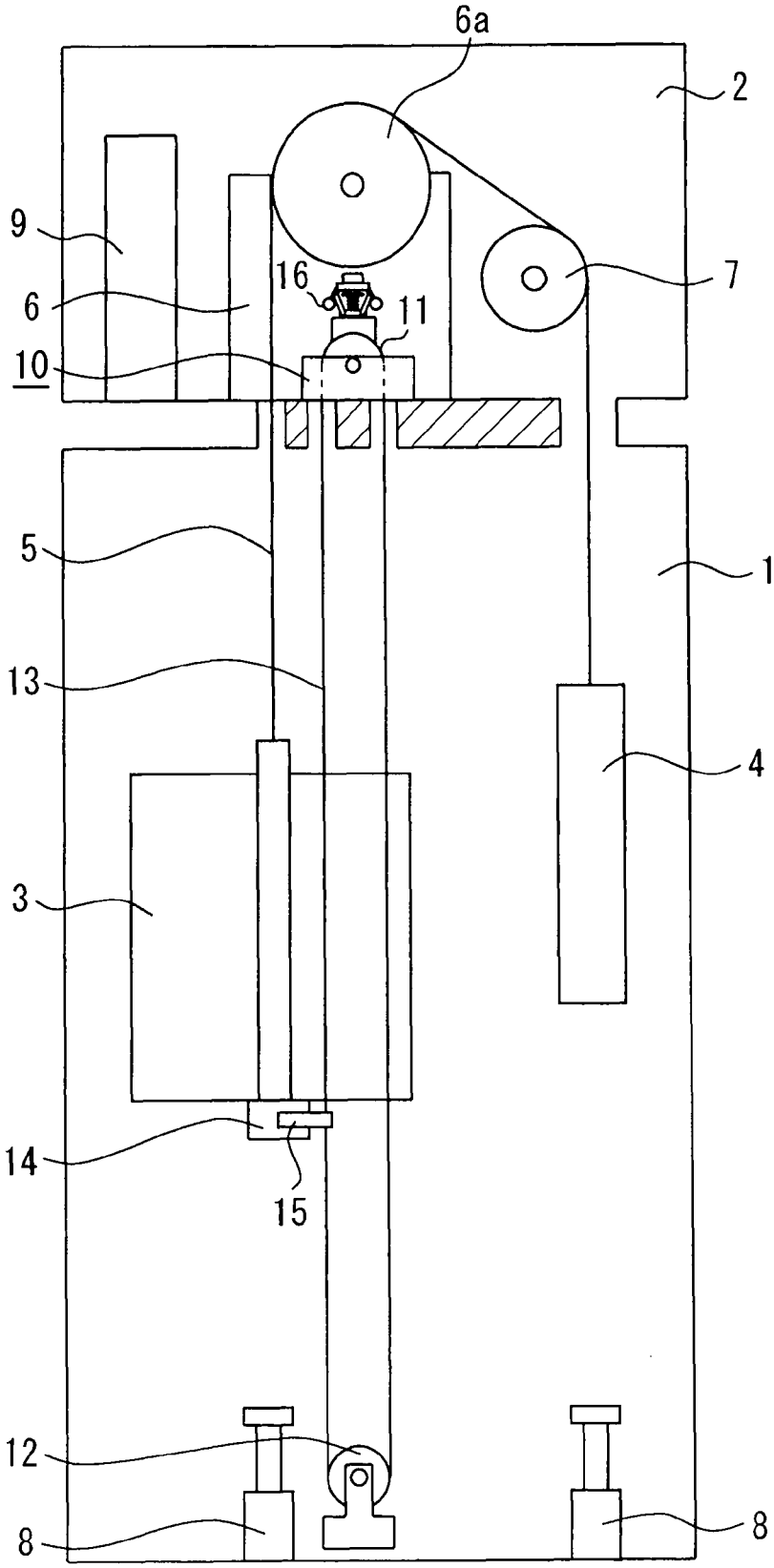
FIG. 1 is a side view of an elevator system in accordance with a first embodiment of the present invention.

1 shaft, 2 machine room, 2*a* machine foundation, 3 car, 4 counterweight, 5 main rope, 6 traction machine, 6*a* driving sheave, 7 deflector sheave, 8 buffer, 9 control unit, 10 governor, 11 sheave, 12 governor tension sheave, 13 governor rope, 14 safety gear device, 15 arm, 16 governing part, 17 support, 18 driving shaft, 19 bearing, 20 driving bevel gear, 21 vertical shaft, 22 bearing, 23 driven bevel gear, 24 fly ball governing mechanism, 25 supporting part, 26 arm, 27 pin, 28 fly ball, 29 sliding cylinder, 30 link, 31 pin, 32 pin, 33 solenoid coil, 34 actuator, 35 retainer, 36 stopper, 37 balance spring, 38 DC generator, 39 generator body, 40 shaft, 41 arm, 42 lead wire, 43 rectifier circuit, 44 driven cylinder, 45 stop switch, 45*a* lever, 46 operating lever, 47 first link, 48 second link, 49 rotating lever, 50 shaft, 51 spring, 52 roller, 53 movable shoe, 54 fixed shoe, 55 fly weight governing mechanism, 56 fly weight, 57 operating element

BEST MODE FOR CARRYING OUT THE INVENTION

The present invention will now be described in detail with reference to the accompanying drawings. In the drawings, the same reference numerals are applied to the same or equivalent elements, and the duplicate explanation of such elements is simplified or omitted as needed.

First Embodiment

FIG. 1 is a side view of an elevator system in accordance with a first embodiment of the present invention. In FIG. 1, reference numeral 1 denotes an elevator shaft provided in a building, 2 denotes a machine room provided above the shaft 1, 3 denotes a car moving up and down in the shaft 1, 4 denotes a counterweight moving up and down in the direction reverse to the car 3 in the shaft 1, 5 denotes a main rope (also referred to as a hoisting rope) for suspending the car 3 and the counterweight 4 in a well bucket manner, and 6 denotes a traction machine that is provided in the machine room 2 and consists of a driving device for driving the car 3. A part of the main rope 5 is set around a driving sheave 6*a* of the traction machine 6, by which the car 3 is moved up and down in the shaft 1 in association with the turning of the driving sheave 6*a*.

Reference numeral 7 denotes a deflector sheave turnably provided in the machine room 2, 8 denotes a buffer for the car 3 and the counterweight 4, which is provided in the pit of the shaft 1, and 9 denotes a control unit that is provided in the machine room 2 and connected to principal equipment of elevator, such as the traction machine 6, to control the whole of the elevator. The control unit 9 moves the car 3 up and down at a preset rising speed and descending speed by controlling the turning of the driving sheave 6*a*. The rising speed and the descending speed of the car 3 are set so as to be different from each other. That is to say, the control unit 9 controls the driving device so that the rated speeds are different between the rising time and the descending time of the car 3.

Reference numeral 10 denotes a governor that constantly monitors the rising/descending speed of the car 3 and emergency stops the car 3 when the car 3 falls into a predetermined overspeed state. This governor 10 includes a governing sheave 11 turnably provided in the machine room 2, a governor tension sheave 12 turnably provided in the pit of the shaft 1 and urged downward, an endless governor rope 13 which is set around the sheave 11 and the governor tension sheave 12 and to which a predetermined tension is given by the governor tension sheave 12, an arm 15 that is connected between a safety gear device 14 provided on the car 3 and the governor rope 13 to interlock the governor rope 13 with the rising/descending operation of the car 3, and a governing part 16 that detects the rising/descending speed of the car 3 based on the turning speed of the sheave 11, and operates so as to emergency stop the car 3 when the car 3 falls into the predetermined overspeed state.

When the rising speed of the car 3 exceeds the rated speed at the rising time and reaches a first overspeed at the rising time (for example, about 1.3 times the rated speed at the rising time), and when the descending speed of the car 3 exceeds the rated speed at the descending time and reaches a first overspeed at the descending time (for example, about 1.3 times the rated speed at the descending time), the governor 10 shuts off the power supply of the traction machine 6 and the power supply of the control unit 9 for controlling the traction machine 6. Also, when the descending speed of the car 3 exceeds the first overspeed at the descending time and reaches a second overspeed at the descending time (for example, about 1.4 times the rated speed at the descending time) from any cause, the governor 10 brakes the governor rope 13 to emergency stops the car 3 mechanically through the operation of the safety gear device 14.

Figure 2:
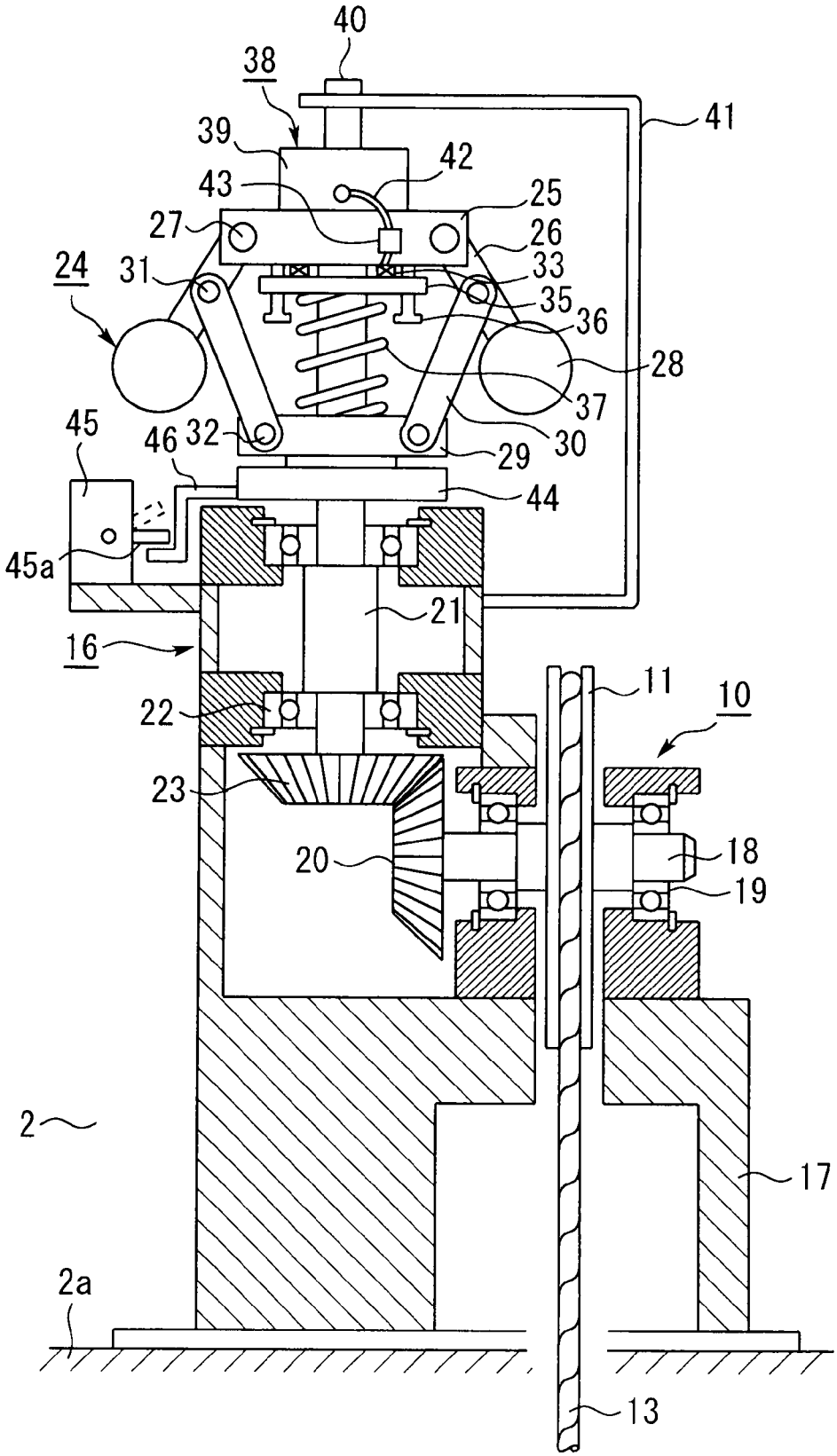
FIG. 2 is a longitudinal sectional view of the elevator governor in accordance with the first embodiment of the present invention.
Figure 3:
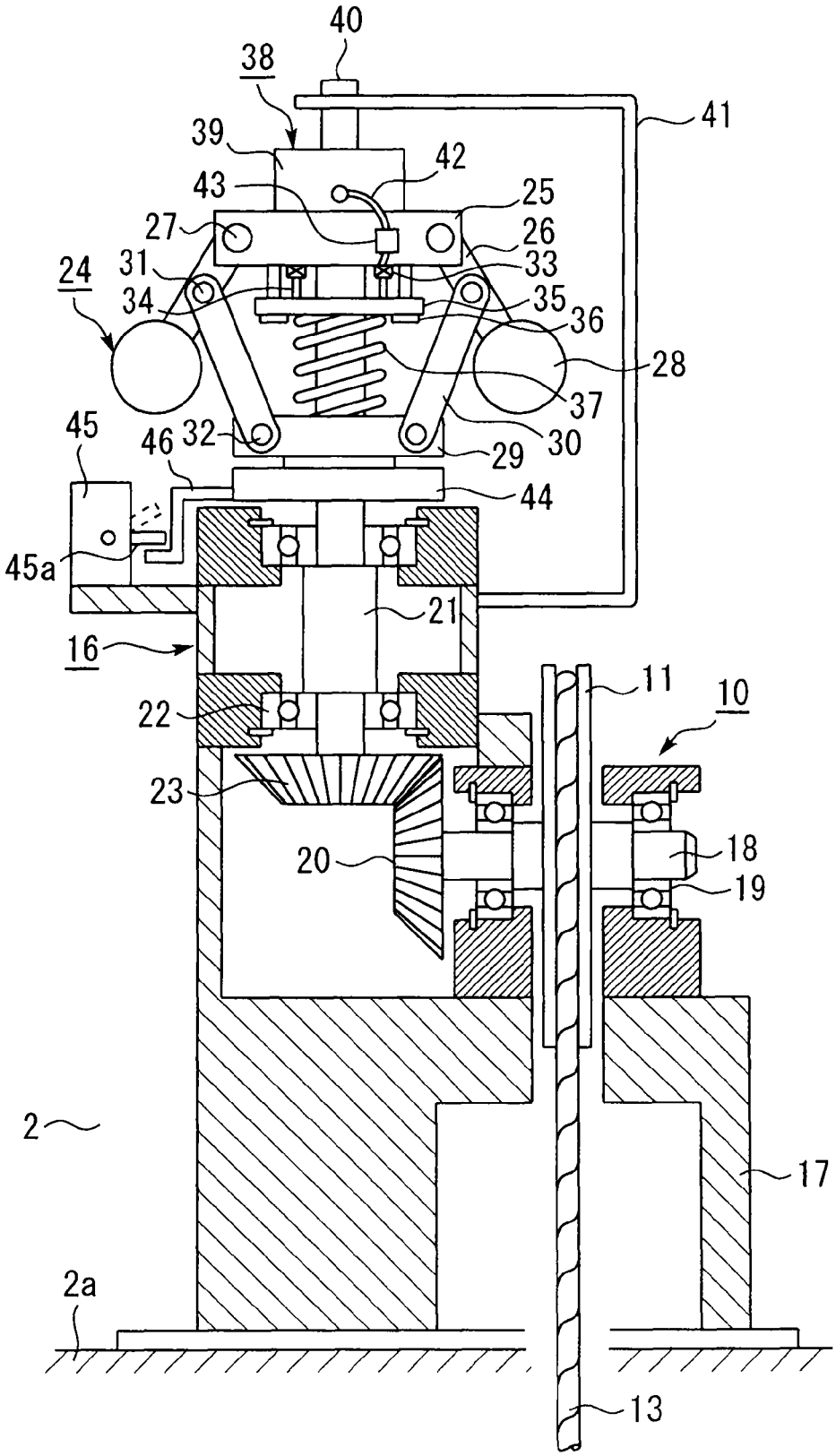
FIG. 3 is a view for explaining the operation of the elevator governor in accordance with the first embodiment of the present invention.

Next, the specific configuration of the governor 10 is explained. FIG. 2 is a longitudinal sectional view of the elevator governor in accordance with the first embodiment of the present invention, and FIG. 3 is a view for explaining the operation of the elevator governor in accordance with the first embodiment of the present invention. In FIG. 2, reference numeral 17 denotes a support provided on the floor surface of the machine room 2 or on a machine foundation 2*a*, and 18 denotes a driving shaft the axial direction of which is horizontal and which is turnably supported on the support 17 via a bearing 19. The sheave 11 is fixed to the driving shaft 18. The sheave 11 is turned together with the driving shaft 18 in association with the movement of the governor rope 13, that is, the rising and descending of the car 3 by a frictional force between the sheave 11 and the upper end curved part of the governor rope 13 set around the sheave groove. For example, when the car 3 descends in the shaft 1, the sheave 11 and the driving shaft 18 turn in the normal direction, and when the car 3 rises in the shaft 1, the sheave 11 and the driving shaft 18 turn in the reverse direction.

Reference numeral 20 denotes a driving bevel gear that is provided in one end part of the driving shaft 18 and arranged concentrically with the turning center of the driving shaft 18, 21 denotes a vertical shaft the axial direction of which is vertical and which is turnably supported on the support 17 via a bearing 22, and 23 denotes a driven bevel gear that is provided in the lower end part of the vertical shaft 21 and arranged concentrically with the turning center of the vertical shaft 21 so as to mesh with the driving bevel gear 20. When the driving shaft 18 is turned in association with the rising or descending of the car 3, the driving bevel gear 20 turns integrally with the driving shaft 18, and the turn of the driving shaft 18 is transmitted to the vertical shaft 21 via the driving bevel gear 20 and the driven bevel gear 23.

Reference numeral 24 denotes a fly ball governing mechanism provided in the upper part of the vertical shaft 21. The fly ball governing mechanism 24 detects the travel speed at the rising time and the descending time of the car 3 based on the rotation direction and the rotational speed of the vertical shaft 21. Also, the fly ball governing mechanism 24 performs operation for emergency stopping the car 3 when the car 3 falls into the predetermined overspeed state. Hereunder, the specific configuration of the fly ball governing mechanism 24 is explained.

Reference numeral 25 denotes a supporting part that is provided in the upper end part of the vertical shaft 21 and turns integrally with the vertical shaft 21, 26 denotes an arm turnably provided in the supporting part 25 by a pin 27 having an upper end part, the axial direction of which is horizontal, 28 denotes a fly ball (weight) having a predetermined mass, which is provided in the lower end part of the arm 26, 29 denotes a sliding cylinder that is disposed under the supporting part 25 and is movable in the axial direction of the vertical shaft 21 along the vertical shaft 21 because the vertical shaft 21 is inserted through a hollow part (not shown) formed in the central part thereof, and 30 denotes a link configured so that the upper end part thereof is turnably provided in a middle part of the arm 26 by a pin 31 and the lower end part thereof is turnably provided on the sliding cylinder 29 by a pin 32. The axial directions of the pins 31 and 32 are horizontal, respectively. The arm 26 and the sliding cylinder 29 are connected to each other so that when the fly ball 28 moves upward to the outside around the pin 27, the link 30 moves the sliding cylinder 29 upward.

Reference numeral 33 denotes a solenoid coil provided on the lower surface of the supporting part 25, 34 denotes an actuator that is configured integrally with the solenoid coil 33 so that a part thereof is projected downward through a predetermined distance by the flow of a current in the solenoid coil 33, 35 denotes a retainer that is provided at the lower end of the actuator 34 and is movable in the axial direction of the vertical shaft 21 along the vertical shaft 21 in association with the projecting operation of the actuator 34 because the vertical shaft 21 is inserted through a through hole (not shown) formed in the central part thereof. 36 denotes a stopper the upper end part of which is provided in the supporting part 25 and the lower end part of which restricts the downward displacement of the retainer 35 to a predetermined position (height), and 37 denotes a balance spring (elastic body) formed by a compression coil spring etc. configured so that the vertical shaft 21 is inserted through the hollow part thereof. The balance spring 37 is disposed between the lower surface of the retainer 35 and the upper part of the sliding cylinder 29 so as to usually urge the sliding cylinder 29 downward by means of a predetermined force. FIG. 3 shows a state in which the actuator 34 is moved downward through the predetermined distance by the flow of a current in the solenoid coil 33.

Also, reference numeral 38 is a DC generator the essential portion of which is formed by a generator body 39 and a shaft 40. The generator body 39 is provided on the upper surface of the supporting part 25, and is disposed so that the center thereof is concentric with the turning center of the vertical shaft 21. That is to say, the generator body 39 is turned integrally with the supporting part 25 by the turning of the vertical shaft 21. Also, the axial direction of the shaft 40 is vertical, and the shaft 40 is arranged concentrically with the turning axis of the vertical shaft 21. The shaft 40 is configured so that the upper end part thereof is fixed to an arm 41 upward the generator body 39 provided so as to extend from the support 17 and the lower end part thereof is disposed from the upside into a concave part (not shown) formed in the upper surface of the generator body 39. Since the DC generator 38 has the above-described configuration, when the generator body 39 turns in association with the turning of the vertical shaft 21 (driving shaft 18), a positive or negative current is produced according to the rotation direction of the generator body 39 with respect to the shaft 40, that is, the rotation direction of the driving shaft 18.

Reference numeral 42 denotes a lead wire that is provided between the generator body 39 and the solenoid coil 33 to carry the current produced by the DC generator 38 to the solenoid coil 33, and 43 denotes a rectifier circuit (rectifying means) that is provided in an intermediate part of the lead wire 42 and is configured so that one of the positive and negative currents produced by the DC generator 38 is carried from the generator body 39 to the solenoid coil 33 and the other thereof is shut off, that is, only either of the positive and negative currents produced by the DC generator 38 is carried from the generator body 39 to the solenoid coil 33. The rectifier circuit 43 sets the rectification direction, for example, so that the current produced by the DC generator 38 when the car 3 rises is carried to the solenoid coil 33 and the current produced by the DC generator 38 when the car 3 descends is not carried to the solenoid coil 33. In this case, when the car 3 rises, the current produced by the DC generator 38 is supplied to the solenoid coil 33, so that the actuator 34 projects downward as shown in FIG. 3. Accordingly, the retainer 35 moves downward against the urging force of the balance spring 37 until the downward displacement thereof is restrained by the stopper 36. On the other hand, when the car 3 descends, the current produced by the DC generator 38 is not supplied to the solenoid coil 33. Therefore, the retainer 35 is urged by the balance spring 37, and therefore, as shown in FIG. 2, is disposed at a position above the position shown in FIG. 3.

Also, reference numeral 44 denotes a driven cylinder that is turnably provided on the sliding cylinder 29 and can be displaced in the axial direction of the vertical shaft 21 (the vertical direction) following the upward and downward movement of the sliding cylinder 29 without turning around the vertical shaft 21 because the vertical shaft 21 is inserted through a hollow part (not shown) formed in the central part thereof, and 45 denotes a stop switch provided on the support 17. When a lever 45*a* provided so as to project toward the vertical shaft 21 side is urged upward, the stop switch 45 shuts off the power supply of the traction machine 6 and the power supply of the control unit 9. Reference numeral 46 denotes an operating lever which is provided so as to project from the driven cylinder 44 toward the stop switch 45 side and the tip end part of which is disposed below the lever 45*a*. The operating lever 46 is disposed so that when the driven cylinder 44 reaches a predetermined position (height), the lever 45 is urged upward to actuate the stop switch 45.

The fly ball governing mechanism 24 is configured as described above, and the fly ball 28 is moved in a predetermined direction by receiving a centrifugal force according to the travel speed at the rising time and the descending time of the car 3, that is, the rotational speed of the driving shaft 18 to urge the balance spring 37. When the fly ball 28 having received the centrifugal force moves to a predetermined position against the urging force of the balance spring 37, the stop switch 45 is actuated by an actuating means, by which the car 3 is emergency stopped.

Specifically, the vertical shaft 21 rotates in one direction in association with the normal rotation of the sheave 11, or rotates in the other direction in association with the reverse rotation of the sheave 11, by which the fly ball 28 is rotated in the same direction as the vertical shaft 21 around the vertical shaft 21. At this time, the fly ball 28 rotating around the vertical shaft 21 receives a centrifugal force according to the rotational speed of the vertical shaft 21, and moves upward to the outside with the pin 27 being the center while rotating around the vertical shaft 21. That is to say, the sliding cylinder 29 and the driven cylinder 44 that move in association with the movement of the fly ball 28 move upward against the urging force of the balance spring 37. When the rising speed of the car 3 reaches the first overspeed at the rising time, or when the descending speed of the car 3 reaches the first overspeed at the descending time, the fly ball 28 (the driven cylinder 44) reaches the predetermined position (height) against the urging force of the balance spring 37, so that the lever 45*a* is urged upward by the operating lever 46. That is to say, by the actuation of the stop switch 45, the power supply of the traction machine 6 and the power supply of the control unit 9 are shut off, and therefore the car 3 is emergency stopped. The above-described actuating means for actuating the stop switch 45 is formed, for example, by the link 30, the sliding cylinder 29, the driven cylinder 44, the operating lever 46, and the like.

Also, in the fly ball governing mechanism 24, the length of the balance spring 37 at the time when the actuating means actuates the stop switch 45 is switched to a length different according to the rising/descending direction of the car 3 by a switching means. This switching means is driven by the rising/descending operation of the car 3 without the need for electric power supply from the outside. For example, the switching means is made up of the DC generator 38, an urging means, and the rectifier circuit 43. The urging means urges one end part of the balance spring 37 against one side by means of the flow of a current to switch the compressed length of the balance spring 37 at the time when the actuating means actuates the stop switch 45 to a length different according to the amount (including the presence or absence) of the flowing current.

Specifically, when the car 3 descends, in the DC generator 38, the generator body 39 rotates in one direction with respect to the shaft 40, thereby producing either one of positive or negative currents. However, the current produced by the DC generator 38 is shut off by the rectifier circuit 43, and is not supplied to the solenoid coil 33. Therefore, the actuator 34 is not activated, and the retainer 35 is disposed at the upper position by the urging force of the balance spring 37. On the other hand, when the car 3 rises, in the DC generator 38, the generator body 39 rotates in the other direction with respect to the shaft 40, thereby producing the other of the positive and negative currents. The current produced by the DC generator 38 is supplied to the solenoid coil 33 without being shut off by the rectifier circuit 43. Therefore, the actuator 34 is activated, and the retainer 35 moves downward so as compress the balance spring 37, and is disposed at the lower position as compared with the time when the car 3 descends. The urging means that switches the length of the balance spring 37 at the time when the stop switch 45 is actuated to a length different according to the amount of the flowing current is, for example, made up of the solenoid coil 33 connected to the DC generator 38, the actuator 34, the retainer 35, the stopper 36, and the like.

Thus, the arrangement of the retainer 35 is switched by the rising/descending direction of the car 3, that is, the precompression amount of the balance spring 37 is switched to two stages. Thereby, the compression amount of the balance spring 37 necessary for raising the operating lever 46 to the actuation position of the stop switch 45 when the car 3 rises is made larger than the compression amount at the time when the car 3 descends by a distance through which the retainer 35 has moved downward. To compress the balance spring 37 (to raise the operating lever 46), the centrifugal force acting on the fly ball 28 must be increased. The amount of this centrifugal force is determined by the rotational speed of the vertical shaft 21 (the travel speed of the car 3) independently of the rotation direction of the vertical shaft 21, that is, the rising/descending direction of the car 3. For this reason, the travel speed of the car 3 at which the stop switch 45 is actuated when the car 3 rises (the first overspeed at the rising time) is higher than the travel speed of the car 3 at which the stop switch 45 is actuated when the car 3 descends (the first overspeed at the descending time) because the balance spring 37 must be compressed excessively by means of the centrifugal force acting on the fly ball 28. Therefore, by adjusting the spring constant of the balance spring 37, the travel distance of the retainer 35 (the arrangement of the stopper 36), and the like, the first overspeed at the rising time and the first overspeed at the descending time can be set at desired speeds different from each other.

According to the elevator governor 10 configured as described above, the first overspeeds different between the rising time and the descending time can be set by a simple configuration and at a low cost without the need for the electric power supply from the outside. Also, unlike the conventional example, two kinds of governing mechanisms need not be provided corresponding to the first overspeed at the rising time and the first overspeed at the descending time, so that the governor size can be reduced. The above is an explanation of the case where the first overspeed at the rising time is higher than the first overspeed at the descending time. Needless to say, by reversing the rectification direction of the rectifier circuit 43, the first overspeed at the descending time can be made higher than the first overspeed at the rising time.

Figure 4:
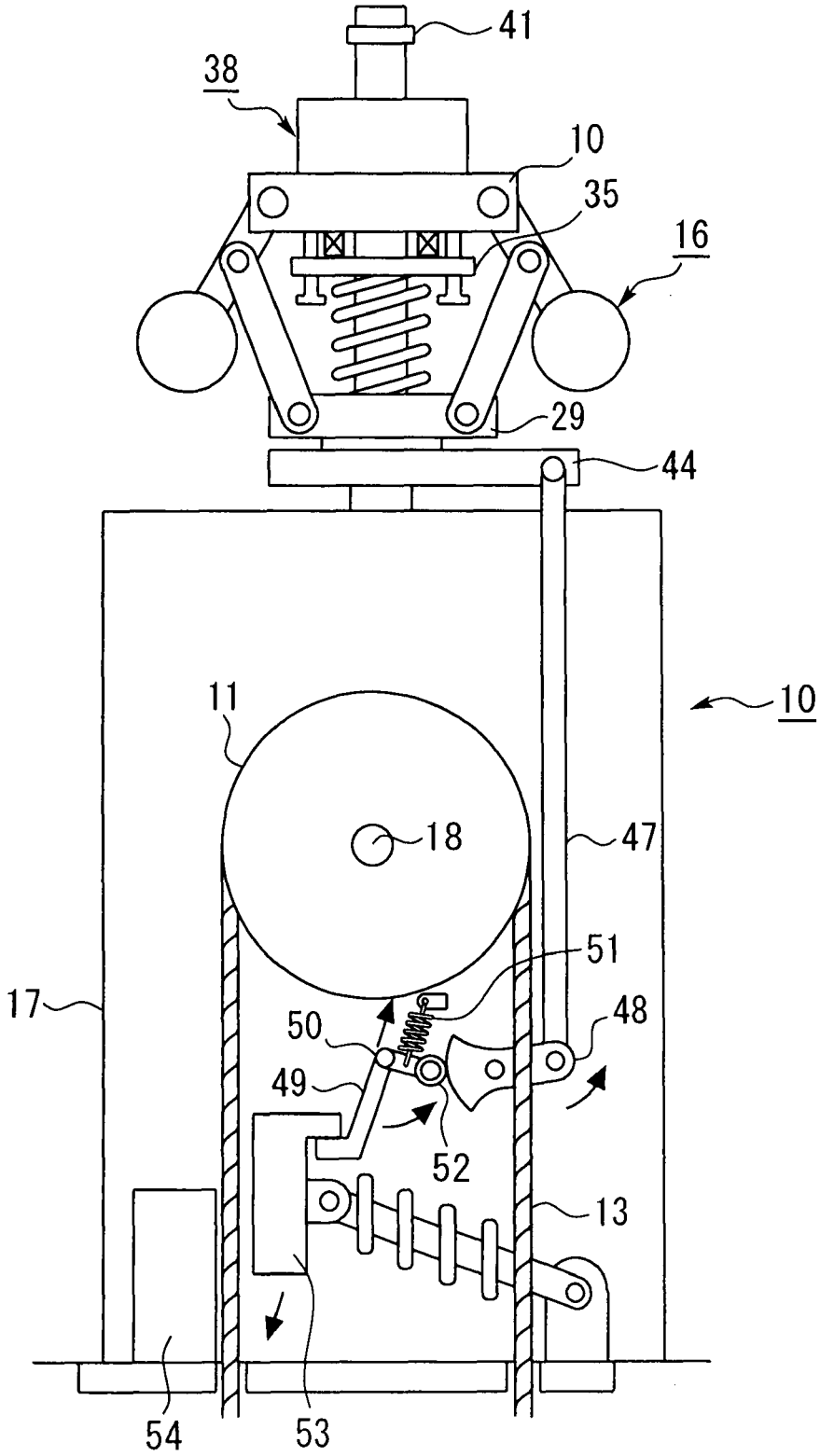
FIG. 4 is a front view of the elevator governor in accordance with the first embodiment of the present invention.

Next, the braking mechanism of the governor 10, which activates the safety gear device 14 when the descending speed of the car 3 exceeds the first overspeed at the descending time and reaches the second overspeed at the descending time is explained. FIG. 4 is a front view of the elevator governor in accordance with the first embodiment of the present invention, showing the configuration of the braking mechanism. In FIG. 4, reference numeral 47 denotes a first link the upper end part of which is connected to the driven cylinder 44, 48 denotes a second link the central part of which is turnably provided on the support 17 and one end part of which is connected to the lower end part of the first link 47, and 49 denotes a rotating lever the central part of which is turnably provided on the support 17 via a shaft 50.

The rotating lever 49 is usually urged by a spring 51 so as to be rotated in one direction around the shaft 50. The rotation of the rotating lever 49 is usually restrained against the urging force of the spring 51 because a roller 52 turnably provided in one end part of the rotating lever 49 comes into contact with the other end part of the second link 48. On the other hand, when the descending speed of the car 3 reaches the second overspeed at the descending time, the second link 48 rotates in association with the rising of the driven cylinder 44, by which the roller 52 comes off the other end part of the second link 48, and the rotating lever 49 is rotated in one direction by the urging force of the spring 51. To the other end part of the rotating lever 49, a movable shoe 53 is hooked. The movable shoe 53 is configured so as to drop from the rotating lever 49 when the descending speed of the car 3 reaches the second overspeed at the descending time and the rotating lever 49 rotates in one direction. The movable shoe 53 having dropped from the rotating lever 49 moves to a predetermined position at which the governor rope 13 is held by the movable shoe 53 and a fixed shoe 54 fixed to the support 17, by which the safety gear device 14 is activated by restraining the movement of the governor rope 13. By the above-described configuration, the second overspeed at the descending time can be detected in the state in which the retainer 35 is disposed at the rising position, and the second overspeed at the descending time can be set at a predetermined value corresponding to the first overspeed at the descending time.

Second Embodiment

Figure 5:
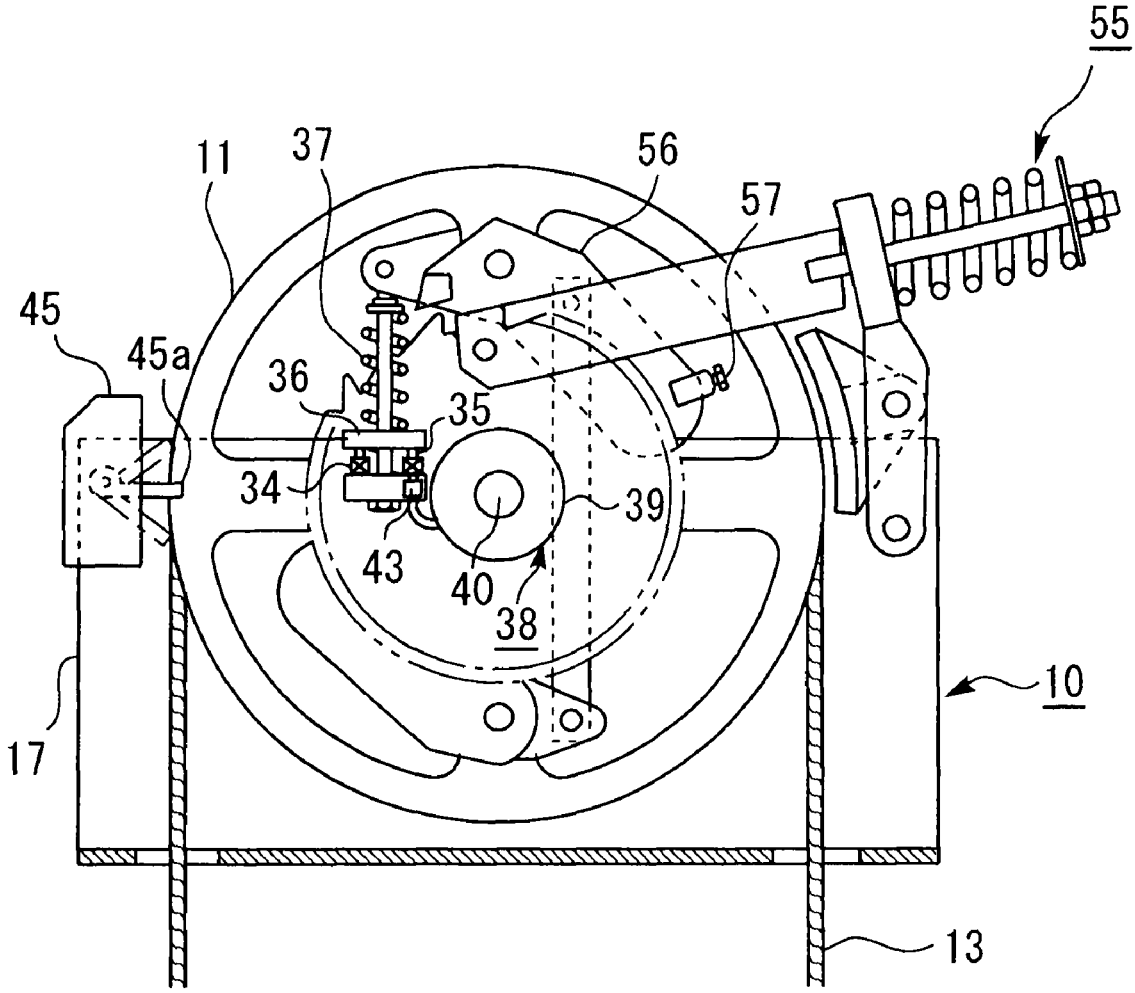
FIG. 5 is a front view of an elevator governor in accordance with a second embodiment of the present invention.

FIG. 5 is a front view of an elevator governor in accordance with a second embodiment of the present invention, showing the governor 10 configured by a fly weight governing mechanism 55. In the governor 10 configured as described above, by receiving a centrifugal force according to the travel speed at the rising time and the descending time of the car 3, that is, the rotational speed of the driving shaft 18, one end part of a fly weight 56 is moved to the outside of the sheave 11 to compress the balance spring 37. When the fly weight 56 having received the centrifugal force moves to a predetermined position against the urging force of the balance spring 37, the stop switch 45 is actuated by an operating element 57 consisting of an actuating means, and the car 3 is emergency stopped.

Also, in the aforementioned fly weight governing mechanism 55, the compressed length of the balance spring 37 at the time when the actuating means actuates the stop switch 45 is switched to a length different according to the rising/descending direction of the car 3 by a switching means. For example, the switching means is made up of the DC generator 38 including the generator body 39 provided on the driving shaft 18 and the shaft 40 provided on the support 17, an urging means, and the rectifier circuit 43 provided between the DC generator 38 and the urging means. The urging means urges one end part of the balance spring 37 against one side by means of the flow of a current to switch the compressed length of the balance spring 37 at the time when the actuating means actuates the stop switch 45 to a length different according to the amount (including the presence or absence) of the flowing current. The urging means is, for example, made up of the solenoid coil 33 connected to the DC generator 38, the actuator 34 a part of which is projected by the flow of a current in the solenoid coil 33, the retainer 35 provided in the tip end part of the actuator 34, the stopper 36 that restricts the displacement of the retainer 35 to a predetermined position, and the like.

By the above-described configuration, even in the governor 10 provided with the fly weight governing mechanism 55, the first overspeeds different between the rising time and the descending time can be set by a simple configuration and at a low cost without the need for electric power supply from the outside. Other configurations and operations of the second embodiment are the same as those of the first embodiment, and the second embodiment can achieve the same effects.

INDUSTRIAL APPLICABILITY

As described above, according to the elevator governor in accordance with the present invention, the first overspeeds different between the rising time and the descending time can be set by a simple configuration and at a low cost without the need for electric power supply from the outside. Therefore, the governor can be applied easily to an elevator having rated speeds different between the rising time and the descending time of the car.

The invention claimed is:

1. An elevator governor for an elevator having rated speeds different between the rising time and the descending time of an elevator car, comprising:

a weight which is moved in a predetermined direction by receiving a centrifugal force according to the travel speed at the rising time and the descending time of the car;

an elastic body which is urged by the movement of the weight having received the centrifugal force;

actuating means for actuating a stop switch when the weight having received the centrifugal force moves to a predetermined position against the urging force of the elastic body; and switching means which is driven by the rising/descending operation of the car to switch the length of the elastic body at the time when the actuating means actuates the stop switch to a length different according to the rising/descending direction of the car.

2. An elevator governor for an elevator having rated speeds different between the rising time and the descending time of an elevator car, comprising:

a driving shaft which rotates in the normal direction and in the reverse direction in association with the rising and descending of the car;

a weight which is moved in a predetermined direction by receiving a centrifugal force according to the rotational speed of the driving shaft;

an elastic body which is urged by the movement of the weight having received the centrifugal force;

actuating means for actuating a stop switch when the weight having received the centrifugal force moves to a predetermined position against the urging force of the elastic body;

a DC generator for generating either of positive or negative currents according to the rotation direction of the driving shaft by means of the rotation of the driving shaft;

urging means for urging one end part of the elastic body against one side by means of the flow of a current to switch the length of the elastic body at the time when the actuating means actuates the stop switch to a length different according to the presence or absence of the flowing current; and rectifying means which is provided between the DC generator and the urging means to supply only either of the positive or negative currents produced by the DC generator to the urging means.

3. The elevator governor according to claim 2, wherein the elastic body is compressed by the movement of the weight having received the centrifugal force; and the urging means urges one end part of the elastic body against one side by means of the flow of a current to switch the compressed length of the elastic body at the time when the actuating means actuates the stop switch to a length different according to the presence or absence of the flowing current.

4. The elevator governor according to claim 2, wherein the urging means comprises:

a solenoid coil connected to the DC generator; and an actuator a part of which is moved by the flow of a current in the solenoid coil so as to urge one end part of the elastic body against one side.

5. An elevator system comprising:

a car which rises and descends in an elevator shaft;

a driving device for driving the car;

a control unit for controlling the driving device so as to provide rated speeds different between the rising time and the descending time of the car;

a weight which is moved in a predetermined direction by receiving a centrifugal force according to the travel speed at the rising time and the descending time of the car;

an elastic body which is urged by the movement of the weight having received the centrifugal force;

actuating means for actuating a stop switch when the weight having received the centrifugal force moves to a predetermined position against the urging force of the elastic body; and switching means which is driven by the rising/descending operation of the car to switch the length of the elastic body at the time when the actuating means actuates the stop switch to a length different according to the rising/descending direction of the car.

6. An elevator system comprising:

a car which rises and descends in an elevator shaft;

a driving device for driving the car;

a control unit for controlling the driving device so as to provide rated speeds different between the rising time and the descending time of the car;

a driving shaft which rotates in the normal direction and in the reverse direction in association with the rising and descending of the car;

a weight which is moved in a predetermined direction by receiving a centrifugal force according to the rotational speed of the driving shaft;

an elastic body which is urged by the movement of the weight having received the centrifugal force;

actuating means for actuating a stop switch when the weight having received the centrifugal force moves to a predetermined position against the urging force of the elastic body;

a DC generator for generating either of positive or negative currents according to the rotation direction of the driving shaft by means of the rotation of the driving shaft;

urging means for urging one end part of the elastic body against one side by means of the flow of a current to switch the length of the elastic body at the time when the actuating means actuates the stop switch to a length different according to the presence or absence of the flowing current; and rectifying means which is provided between the DC generator and the urging means to supply only either of the positive or negative currents produced by the DC generator to the urging means.

7. The elevator governor according to claim 3, wherein the urging means comprises:

a solenoid coil connected to the DC generator; and an actuator a part of which is moved by the flow of a current in the solenoid coil so as to urge one end part of the elastic body against one side.

* * * * *

UNITED STATES PATENT AND TRADEMARK OFFICE

CERTIFICATE OF CORRECTION

PATENT NO. : 8,069,956 B2
APPLICATION NO. : 12/440950
DATED : December 6, 2011
INVENTOR(S) : Mineo Okada It is certified that error appears in the above-identified patent and that said Letters Patent is hereby corrected as shown below:

On the title page, Item (54) and column 1, the title is incorrect. Item (54) and column 1 should read:

-- ELEVATOR GOVERNOR AND ELEVATOR SYSTEM --

Signed and Sealed this
Twenty-eighth Day of February, 2012

David J. Kappos

David J. Kappos
*Director of the United States Patent and Trademark Office*